United States Patent [19]

Wen

[11] Patent Number: 5,059,952

[45] Date of Patent: Oct. 22, 1991

[54] SURVIVOR LOCATOR LIGHT WITH WATER-ACTIVATED SWITCHES

[76] Inventor: Samuel C. Wen, 30-15 50th St., Woodside, N.Y. 11377

[21] Appl. No.: 515,625

[22] Filed: Apr. 27, 1990

[51] Int. Cl.[5] ..... G08B 23/00; H01H 29/00

[52] U.S. Cl. ..... 340/573; 200/61.04; 200/61.19; 340/321; 340/604

[58] Field of Search ..... 340/573, 604, 321, 332, 340/605; 200/61.04, 61.19; 73/73, 76; 324/658, 691; 362/802

[56] References Cited

U.S. PATENT DOCUMENTS

| | | | |
|---|---|---|---|
| 3,437,769 | 4/1969 | Vincent | 200/61.04 |
| 3,492,449 | 1/1970 | Kenny | 200/61.04 |
| 3,600,674 | 8/1971 | Roberts et al. | 340/605 X |
| 3,622,721 | 11/1971 | Hodes | 200/61.04 |
| 3,671,912 | 6/1972 | LaSota | 200/61.04 X |
| 3,686,656 | 8/1972 | Richards | 200/61.04 X |
| 3,720,797 | 3/1973 | Gunn et al. | 340/605 X |
| 3,810,146 | 5/1974 | Lieb | 340/573 X |
| 3,914,592 | 10/1975 | Maxey | 200/61.04 X |
| 3,959,980 | 6/1976 | Hamilton | 340/604 X |
| 4,001,531 | 1/1977 | Crockett | 200/61.04 |
| 4,079,364 | 3/1978 | Antenore | 340/573 |
| 4,193,068 | 3/1980 | Ziccardi | 340/604 |
| 4,234,819 | 11/1980 | Maxey | 200/61.04 X |
| 4,427,976 | 1/1984 | Lord | 340/604 |
| 4,585,190 | 4/1986 | Hansen | 200/61.04 X |
| 4,638,291 | 1/1987 | Puscasu | 340/59 |
| 4,714,914 | 12/1987 | Boe | 340/573 |
| 4,834,733 | 5/1989 | Huntoon et al. | 73/73 X |
| 4,888,455 | 12/1989 | Hanson | 200/61.04 |
| 4,918,433 | 4/1990 | Moore | 340/573 |

*Primary Examiner*—Glen R. Swann, III
*Assistant Examiner*—Thomas J. Mullen, Jr.

[57] ABSTRACT

A light assembly includes a light bulb, a socket, batteries, a novel water activated electrical switch, a novel manual override, a novel desiccant to keep the ambient air dry, and a case for housing all components. This invention includes four novel water-activated switching methods: (a) by tape that is made of water soluble material, (b) by adhesive that is water soluble, (c) by crystal that is also water soluble, and (d) by media that will absorb water and expand their volumes.

12 Claims, 2 Drawing Sheets

SURVIVOR LOCATOR LIGHT WITH WATER-ACTIVATED SWITCHES

BACKGROUND OF THE INVENTION

1. Field of Invention

This invention relates to survivor locator lights, specifically to the water-activated automatic electrical switching methods. Nevertheless, a manual override device is also included in this invention.

2. Description of Prior Art

Life vests and life rafts carried in aircraft and ships as part of the emergency equipment are normally equipped with survivor locator lights. These lights will facilitate rescuers to locate survivors at night.

There are such lights on the market. They use battery as power source and employ one of the following switching methods for turning the light on:

(a) By manual action—This type of switching methods must be actuated manually. An unconscious survivor will not be able to operate it, not to mention where to find the switch at night.

(b) By electronic moisture sensing circuits—They must consume electric energy to function. In emergency situations an extra bit of energy may just save a life. U.S. Pats. Nos. 3,671,912 to LaSota (1971), 3,914,592 to Maxey (1974), 4,001,531 to Crockett (1975), 4,234,819 to Maxey (1979), 4,585,190 to Hansen (1984), and 4,714,914 to Boe (1986) are all operated in this manner.

(c) By water conductivity—Water is not a good conductor, especially in low voltage application such as this light. Reduced illumination will result due to water resistance. U.S. Pats. Nos. 3,437,769 to Vincent (1967), 3,492,449 to Kenny (1968), 3,622,721 to Hodes (1965), 4,427,976 to Lord (1979), and 4,638,291 to Puscasu (1984) are of this design but for different applications.

(d) By water-activated battery—When this type of battery, magnesium-cuprous chloride battery for example, is immersed in water, chemical reaction will take place to generate electricity and, as a result, produce substantial amount of magnesium and copper compounds into the water in the immediate vicinity of the survivor's mouth, nose and eyes because most of such batteries are attached to life jackets at a location only few inches from the front of the wearer's head.

OBJECTS AND ADVANTAGES

Accordingly, several objects and advantages of my invention are:

(a) to provide a simple and effective locator light assembly that will turn on automatically in water;

(b) to provide a simple and effective manual override backup means should the automatic switching method fail;

(c) to provide a life saving light that is of simple design and inexpensive to manufacture;

(d) to provide a life saving light that will not produce chemicals harmful to its user; and (e) to provide switching methods that will not consume electric energy during its storage and stand-by period.

Still further objects and advantages will become apparent from a consideration of the ensuing description and drawings.

BRIEF DESCRIPTION OF THE DRAWINGS

In the drawings, like reference numerals are used throughout to designate like elements and components. It is to be expressly understood, however, that the drawings are for the purpose of illustration only, and are not intended as a definition of the limits of the invention.

Figure 1:
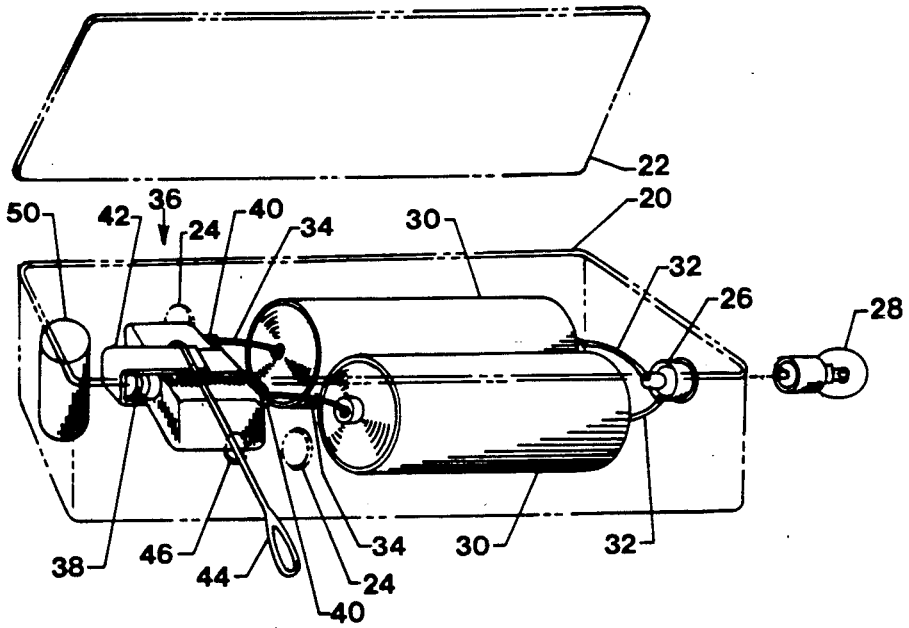
FIG. 1 shows an assembled survivor locator light exposing its components and wiring connections. Note that the switch 36 is in OFF position because plunger 38 has been pressed and held in by tape 42.

| REFERENCE NUMERALS IN DRAWINGS | | |
|---|---|---|
| 20 | Case for light assembly | shown in phantom lines for clarity. |
| 22 | Cover for case 20 | |
| 24 | Hole for water entry | |
| 26 | Socket for light bulb 28 | |
| 28 | Light bulb | |
| 30 | Batteries | |
| 32 | Wires from batteries to bulb | |
| 34 | Wires from batteries to switch | |
| 36 | Switch | |
| 38 | Switch plunger | |
| 40 | Switch terminals | |
| 42 | Water soluble tape | |
| 44 | Manual override string | |
| 46 | Opening for override access | |
| 50 | Desiccant | |
| 62 | Insulation block | |
| 64 | Switch | |
| 66 | Fixed contact point | |
| 68 | Movable contact point | |
| 69 | Arm for movable point 68 | |
| 72 | Water soluble crystal | |
| 74 | Switch | |
| 76 | Insulation block | |
| 80 | Coil spring | |
| 82 | Switch | |
| 84 | Switch case | |
| 86 | Fixed contact point | |
| 88 | Movable contact point | |
| 90 | Switch | |
| 92 | Switch case | |
| 94 | Flexible wire | |

-continued

| REFERENCE NUMERALS IN DRAWINGS | |
|---|---|
| 96 | Water absorbent expanding medium. |

DESCRIPTION OF THE PREFERRED EMBODIMENT

Figure 8:
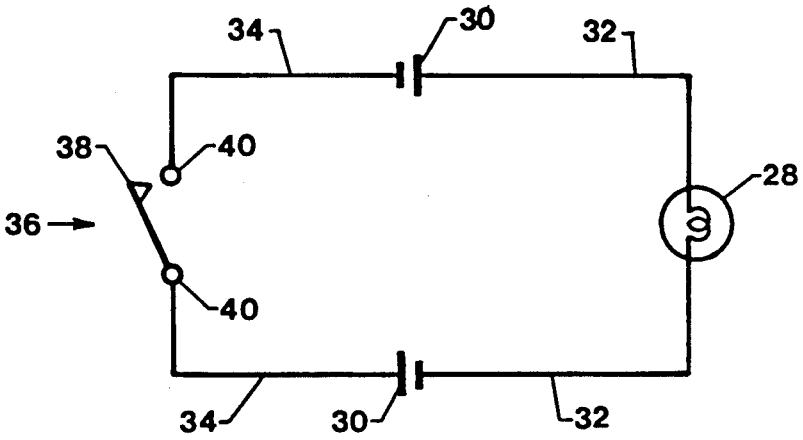
FIG. 8 is the circuit diagram of the survivor locator light. Standard electrical symbols are used to indicate the components.

A typical embodiment of a novel survivor locator light assembly of the invention is illustrated in FIG. 1, to which no limitation is intended. Its electrical circuitry is shown in FIG. 8. In FIG. 1, a light bulb 28 and its socket 26 is connected to a set of batteries 30 by wires 32. The batteries 30 will supply the electric power required to light the bulb 28. A switch 36 of novel design is connected in series to the other ends of the batteries by wires 34 through switch terminals 40. The ON-OFF action of the switch 36 is by the movement of its spring-loaded plunger 38. When the plunger 38 is pressed in by an outside force, the switch 36 is in OFF position and vice versa. This invention creates a novel, simple and effective method of using a tape 42 as the outside force to hold the plunger 38 IN (switch OFF) as shown in FIG. 1. The tape 42 can either be made of materials that will disintegrate in water or use water-soluble adhesive for attaching its two ends together. This invention also creates a novel manual override device 44 which is shown looping around tape 42. Pulling the override string 44 will cut tape 42 apart. A desiccant 50 is used to keep the tape 42 dry, another novel idea of this invention. All the above-described components are housed in a case 20 with cover 22. (Both case and cover are shown in phantom lines for clarity.) Holes 24 on the case 20 side wall are for water to enter into the case to act on tape 42. Hole 46 is the access opening for the override string 44.

Figure 2:
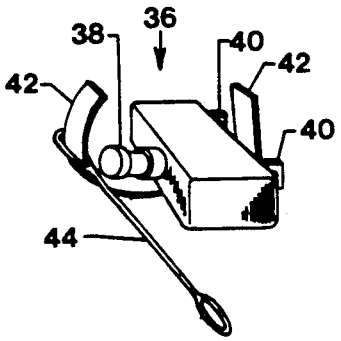
FIG. 2 shows that tape 42 becomes loose due to the adhesive on the two ends of tape 42 dissolved in water. Plunger 38 popped out, the switch is in ON position.

FIG. 2 shows the tape 42 become loose because the adhesive bonding its ends has dissolved, as shown. The plunger 38 is free to pop out, turning the switch 36 ON.

Figure 3:
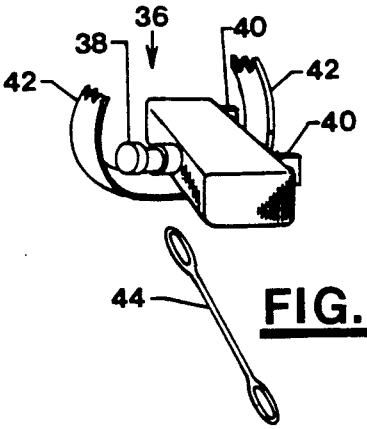
FIG. 3 shows that tape 42 has been cut apart by the manual override 44 and becomes loose. Plunger 38 popped out, the switch is in ON position.

FIG. 3 shows the tape 42 has been cut apart by the manual override string 44. The plunger 38 has popped out turning switch 36 ON.

Figure 4:
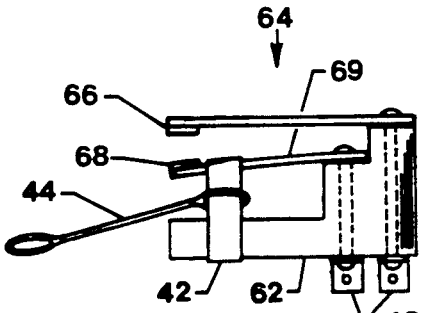
FIG. 4 shows a switch 64 of lever spring construction. It still uses water-soluble tape 42 as a switching means.

Another switch 64 is shown in FIG. 4. It has a fixed point 66 and a movable point 68. The arm 69 for point 68 is made of a lever spring which has a tendency to force point 68 move towards point 66 by its spring action. Both points are mounted on an insulation block 62 and electrically connected to terminals 40 respectively. The movable point 68 is shown held away from the fixed point 66 by a water-soluble tape 42. The manual override string 44 is looped around tape 42.

Figure 5:
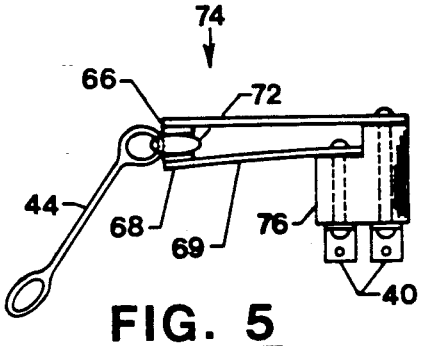
FIG. 5 shows a spring lever type switch 74 that employs a water soluble crystal 72 as a switching means.
Figure 6:
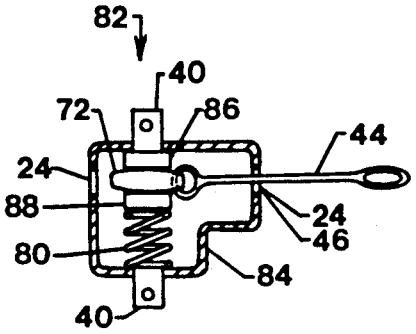
FIG. 6 shows a coil spring type switch 82 that also employs a water soluble crystal 72 as a switching means.

This invention also creates another water-activated switching method as described in FIGS. 5 and 6 following. In this novel method, a non-conductive, water soluble crystal is inserted in between two electrical contact points. When the crystal is dissolved in water, the points are able to contact each other by spring action.

In FIG. 5, switch 74 has a fixed point 66 and a movable point 68. Both points are mounted on an insulation block 76 and electrically connected to terminals 40 respectively. The arm 69 of the movable point 68 is made of a lever spring, which forces point 68 to contact fixed point 66 at all times.

A water-soluble crystal 72 is shown placed in between these points, separating them from contacting each other. However, if crystal 72 dissolved in water and thus disappeared, points 66 and 68 will make contact. Crystal 72 is attached to a manual override string 44. Pulling string 44 will remove the crystal 72 from its seat and permit the points to make contact.

FIG. 6 shows a switch 82 that uses a coil spring 80 instead of lever spring described earlier. Switch 82 has a fixed point 86 and a movable point 88. Both points are electrically connected to terminals 40 respectively. The fixed point 86 is attached to the switch case 84 at one end. The movable point 88 is attached to the other end through a coil spring 80 as shown. A non-conductive, water soluble crystal 72 is held in between these points by the pressure of spring 80. The crystal 72 is attached with a string 44 for manual override purpose. Holes 24 on the switch case 84 are for water entry. Hole 46 is the opening for override access. On right side of case 84, both openings 24 and 46 share a common hole.

Figure 7:
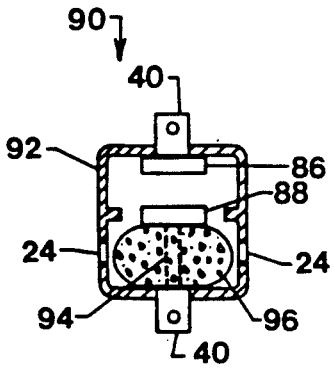
FIG. 7 shows a switch 90 that employs a water-absorbent expanding medium 96 as a switching means.

Another novel idea of this invention is the application of water-absorbent media, such as dried sponge, as a switching method. Such media will expand their volume manifold after absorbing water. This expanding action is creatively employed by this inventor to actuate a switch 90. In FIG. 7, a fixed point 86 and its terminal 40 is attached to the upper end of the switch case 92. A movable point 88 is attached to the lower terminal 40 through a flexible wire 94. A water-absorbent medium 96 is placed behind point 88. Medium 96 will expand its volume after absorbing water entered from holes 24 and force point 88 to contact point 86.

The electrical circuitry of the survivor locator light is shown in FIG. 8. Light bulb 28 is connected to batteries 30 by wires 32. A typical water activated switch 36 of this invention is connected to the other ends of batteries 30 at the switch terminals 40 by wires 34. Switch 36 is normally at OPEN position as shown. When activated by water, it will CLOSE and turn the light 28 ON.

According to preceding descriptions, a number of advantages of the water-activated survivor locator lights of this invention become evident:

(a) A survivor at sea wearing a life jacket, on which a survivor locator light of this invention is attached, can be easily spotted at night because of the automatic in-water turn-on feature of this invention.

(b) Should the automatic feature fail, the light still can be turned on manually by the novel, simple and effective manual override of this invention.

(c) If the survivor is on land, the light can also be turned on by actuating the manual override.

(d) The water-activated switching method by this invention is simple, effective, unique and reliable.

(e) It is an effective life saving invention.

(f) Unlike some locator lights, the batteries used in this invention do not produce toxic chemicals harmful to its user.

(g) Unlike some other water-activated devices, the switching method of this invention do not consume electric energy during storage and use. Only the light bulb consumes energy when turned on. An important energy saving feature for surviving equipment.

(h) The design of this invention employs few simple parts, most of which are readily available in the market. Its simple design will facilitate easy and inexpensive manufacture thereof.

OPERATION

The Survivor Locator Light of this invention is used for the purpose of facilitating rescuers to spot a survivor at night. This invention provides an automatic turn-on feature of the light, even if the survivor is in a state of unconsciousness. This invention also provides a manual turn-on feature as a back-up for the automatic switch.

In FIG. 1, a light bulb 28 and its socket 26 are connected to a set of batteries 30. A switch 36 is connected in series in the circuit. The ON-OFF action of the switch 36 is actuated by a spring-loaded plunger 38. When plunger 38 pops out by its spring, switch 36 is in ON position. Pressing plunger 38 in will turn switch 36 OFF. To maintain switch 36 in OFF position during stand-by and storage times, a tape 42 is used to press plunger 38 in and hold it in that position as shown in FIG. 1. When switch 36 is immersed in water, tape 42 or its adhesive will dissolve, permitting plunger 38 to pop out and turning the switch ON as shown in FIG. 2.

In FIGS. 1 and 2, there is a piece of string 44 looping around tape 42. This is the manual override. Pulling string 44 will cut tape 42 apart to permit plunger 38 to pop out and turn on the light. FIG. 3 shows tape 42 has been cut and the override string 44 laid on side.

Another switch 64 is shown in FIG. 4. Points 66 and 68 are attached to an insulation block 62. Since the arm 69 of point 68 is made of a lever spring, it has a natural tendency to force point 68 to contact point 66. Tape 42 is used to hold back point 68 from contacting point 66. In water, tape 42 will dissolve and loose its holding ability. Point 68 will then be able to make contact with point 66 by the spring action of its arm 69 and turn on the switch. Manual override 44 is as same as described before.

FIG. 5 shows switch 74 of similar construction as switch 64 above but using a novel non-conductive water-soluble crystal 72 to control the ON-OFF function. Crystal 72 is inserted in between points 66 and 68. In water, crystal 72 will dissolve and disappear permitting point 68, by spring tension of its arm 69, to contact point 66. A manual override string 44 is attached to crystal 72. Pulling string 44 will remove crystal 72 from its seat.

FIG. 6 shows a switch 82 using the same water-soluble crystal 72 as an ON-OFF control but of different construction. A fixed contact point 86 is attached to one end of the switch case 84. A movable contact point 88 is attached to the other end through a coil spring 80. The crystal 72 is inserted in between the points 86 and 88, separating them from contacting each other. Crystal 72 will dissolve and disappear in water permitting point 88, by the force of spring 80, to make contact with point 86. Crystal 72 is attached to an override string 44 which is used for removing the crystal 72 from its seat manually. The operation of switch 90 as shown in FIG. 7 is rather novel and unique. Fixed point 86 with its terminal 40 is attached to the upper end of the switch case 92. Movable point 88 is mechanically attached to a water absorbent expansion medium 96 and electrically connected to the lower terminal 40 through a flexible wire 94 as shown. After absorbing water, medium 96 will expand its volume many times and force point 88 moving towards point 86 to make the contact.

SUMMARY, RAMIFICATIONS AND SCOPE

Accordingly, the reader will see that the water-activated survivor locator light of this invention can provide a simple and effective light for the survivor to be spotted and rescued at sea at night. More valuable is the fact that the light is able to turn on automatically when immersed in water even though the survivor has lost consciousness. If is on land, the light can be turned on manually. Furthermore, the locator light has the additional advantages in that it provides for design selections, a number of water-activated switching methods by using water soluble tapes, water soluble adhesives, water soluble crystals, and water absorbent expanding media; and it provides a life saving light that is simple in design and inexpensive to manufacture.

Although the descriptions above contains many specifications, these should not be construed as limiting the scope of the invention but as merely providing illustrations of some of the presently preferred embodiments of this invention. For example, the switch can be lever spring type, coil spring type, microswitch, etc.

Thus the scope of the invention should be determined by the appended claims and their legal equivalents, rather than by the examples given.

I claim:

1. Apparatus comprising:

means for closing a circuit to activate a light source which is electrically connected to said circuit;

means for preventing said closing means from closing said circuit, said preventing means physically touching said closing means, at least part of said preventing means disintegrating, when in contact with a fluid containing water, so as to activate said light source; and means for removing said preventing means so as to activate said light source when said apparatus is free from said fluid.

2. The apparatus of claim 1 wherein said apparatus further includes a desiccant which absorbs moisture.

3. The apparatus of claim 1 wherein said preventing means is a tape including a water-soluble adhesive.

4. The apparatus of claim 1 wherein said preventing means is a water-soluble tape.

5. The apparatus of claim 1 wherein said preventing means is a tablet which is soluble in water.

6. The apparatus of claim 1 wherein said closing means is a switch.

7. Apparatus operating in a selected one of first and second environments, where the first environment includes water and the second environment is without water, said apparatus comprising:

a light source which is activated by a circuit-closing device;

means for preventing said circuit-closing device from activating said light source, said preventing means physically touching said circuit-closing device, at least part of said preventing means disintegrating, when placed in said first environment from said second environment, so as to activate said light source; and means for removing said preventing means so as to activate said light source when said apparatus is in said second environment.

8. The apparatus of claim 7 wherein said apparatus further includes a desiccant which absorbs moisture.

9. The apparatus of claim 7 wherein said preventing means is a tape including water-soluble adhesive.

10. The apparatus of claim 7 wherein said preventing means is a water-soluble tape.

11. The apparatus of claim 7 wherein said preventing means is a tablet which is soluble in water.

12. The apparatus of claim 7 wherein said circuit-closing device is a switch.

* * * * *